US006139277A

United States Patent [19]

Lopatinsky

[11] Patent Number: 6,139,277

[45] Date of Patent: Oct. 31, 2000

[54] MOTORIZED FAN

[75] Inventor: Edward Lopatinsky, La Jolla, Calif.

[73] Assignee: Air Concepts, Inc., Chula Vista, Calif.

[21] Appl. No.: 09/218,399

[22] Filed: Dec. 22, 1998

[51] Int. Cl.[7] ..... B63H 1/20

[52] U.S. Cl. ..... 416/220 A

[58] Field of Search ..... 416/219 R, 220 R, 416/220 A, 219 A

[56] References Cited

U.S. PATENT DOCUMENTS

| | | | |
|---|---|---|---|
| 390,615 | 10/1888 | Nye | 416/220 R |
| 417,865 | 12/1889 | Green | 416/219 R X |
| 752,670 | 2/1904 | Hamilton | 416/220 R |
| 1,363,660 | 12/1920 | La Fleur | 416/220 R X |
| 1,819,728 | 8/1931 | Baugh | 416/220 R X |
| 2,773,169 | 12/1956 | Lees | 416/219 R X |
| 3,073,395 | 1/1963 | Duncan | 416/220 A X |
| 3,887,298 | 6/1975 | Hess et al. | 416/220 R |
| 3,957,393 | 5/1976 | Bandurick | 416/220 R |
| 4,080,101 | 3/1978 | Zlotek . | |
| 4,191,509 | 3/1980 | Leonardi . | |
| 4,451,202 | 5/1984 | Hauser . | |
| 4,451,203 | 5/1984 | Langley . | |
| 4,451,204 | 5/1984 | Pask . | |
| 4,451,205 | 5/1984 | Honda et al. . | |
| 4,462,757 | 7/1984 | Uemura . | |
| 4,715,784 | 12/1987 | Mosiewicz . | |
| 4,915,587 | 4/1990 | Piez et al. . | |
| 5,263,823 | 11/1993 | Cabaret et al. | 416/220 R X |
| 5,354,177 | 10/1994 | Chang | 416/219 A |
| 5,501,576 | 3/1996 | Monroe . | |

FOREIGN PATENT DOCUMENTS

| | | |
|---|---|---|
| 868130 | 9/1981 | Russian Federation . |
| 922324 | 4/1982 | Russian Federation . |

*Primary Examiner*—John E. Ryznic
*Attorney, Agent, or Firm*—Edward Dreyfus

[57] ABSTRACT

A motor drives a hub having axially extending blind tapered recesses to receive tapered shoes on a plurality of blades, and threads which fasten a ring that presses the shoes axially into the recesses have a hand-direction that tend to tighten in response to the rotation of the shaft. The recess is partially defined by a forward downward sloping upper wall. The shoe includes a forward downward upper surface. The recess sloping wall functions as a positive stop for seating the shoe by engaging the sloping shoe surface and as a centrifugal force absorbing wall during rotation of the blades.

10 Claims, 7 Drawing Sheets

MOTORIZED FAN

FIELD OF THE INVENTION

This invention relates to motorized fans and particularly to fan assemblies that are driven by motors.

BACKGROUND OF THE INVENTION

In motorized fans, a motor drives a hub which supports a multiplicity of radially extending fan blades. The positions of the supports are subject to great stress. Moreover, the blades to the hub may be subject to vibrations or other stresses that damage the blades or the hub. These and other factors make it necessary to remove blades from their supports on the hub and to attach new blades at these supports. To avoid the necessity of removing all the blades when only one or some are damaged, it is desirable to be able to remove one at a time. However, singly removable blades are difficult to secure, particularly in view of stresses endured by the blades, and the tendency of objects subject to vibration to loosen.

OBJECTS OF THE INVENTION

An object of the invention is to improve motorized fans.

Another object is to improve fan assemblies used in motorized fans.

A further object is to enable the efficient changing of fan performance by changing the number of blades in the fan.

SUMMARY OF EMBODIMENTS OF THE INVENTION

According to one embodiment of the invention, a motor drives a hub having axially extending tapered or wedge-shaped recesses to receive tapered or wedge-shaped shoes on a plurality of blades, and threads which fasten a ring that presses the shoes axially into the recesses. Preferably, the threaded direction tends to tighten the ring in response to the rotation of the motor or shaft. This prevents loosening of the ring and maintains the ring and shoes well seated.

According to another embodiment the recesses are blind and are defined partially by downward forward sloping wall of the hub which acts as positive stops and a blade or shoe centrifugal force absorbing surface.

According to yet another embodiment the recesses extend further than the tapered portions of the shoes.

These and other aspects of the invention are pointed out in the claims. Other objects and advantages of the invention will become evident when read in light of the following drawings.

DETAILED DESCRIPTION OF PREFERRED EMBODIMENTS

Figure 1:
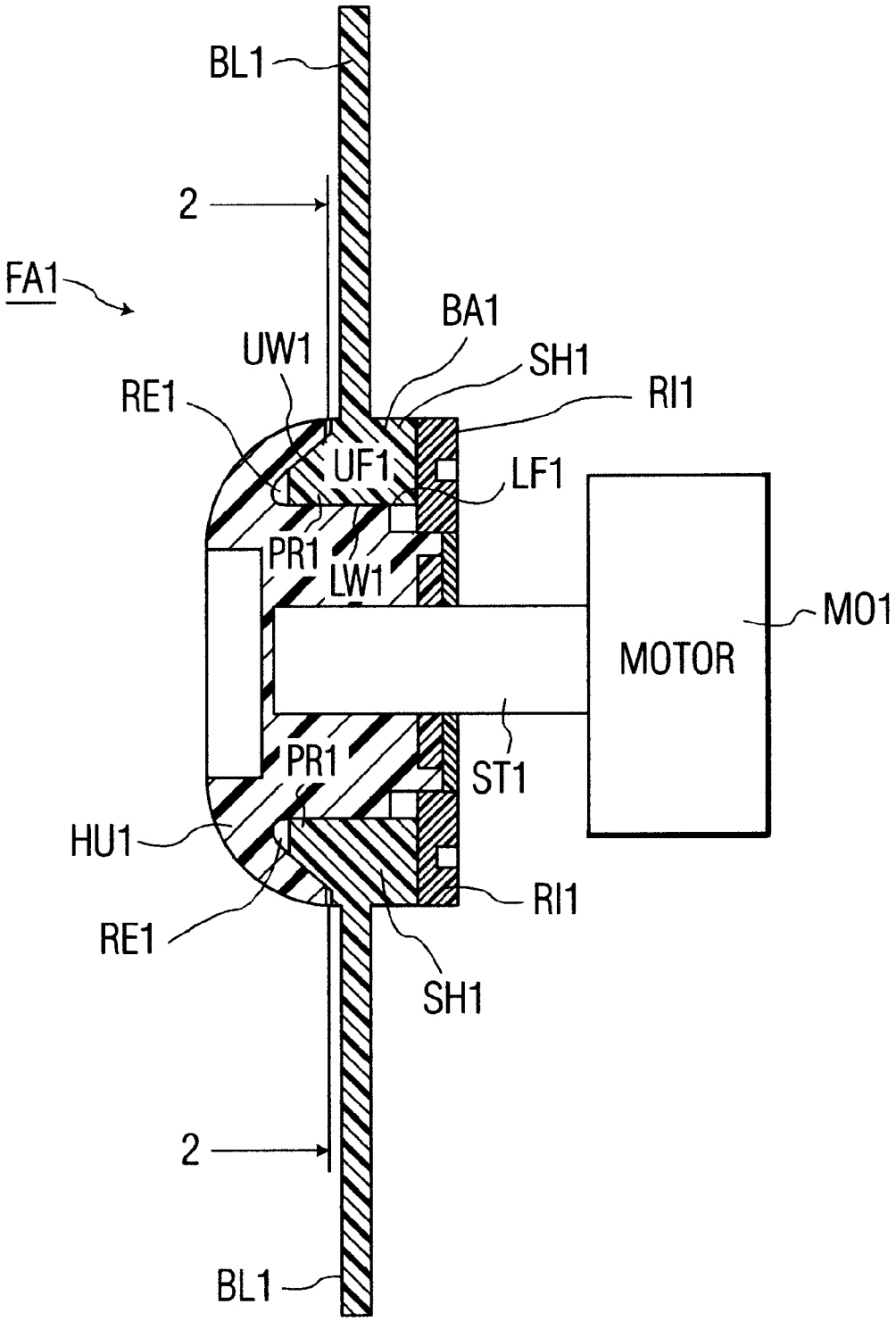
FIG. 1 is a partially sectional and partially schematic representation of a motorized fan representing one exemplary embodiment of the invention.
Figure 2:
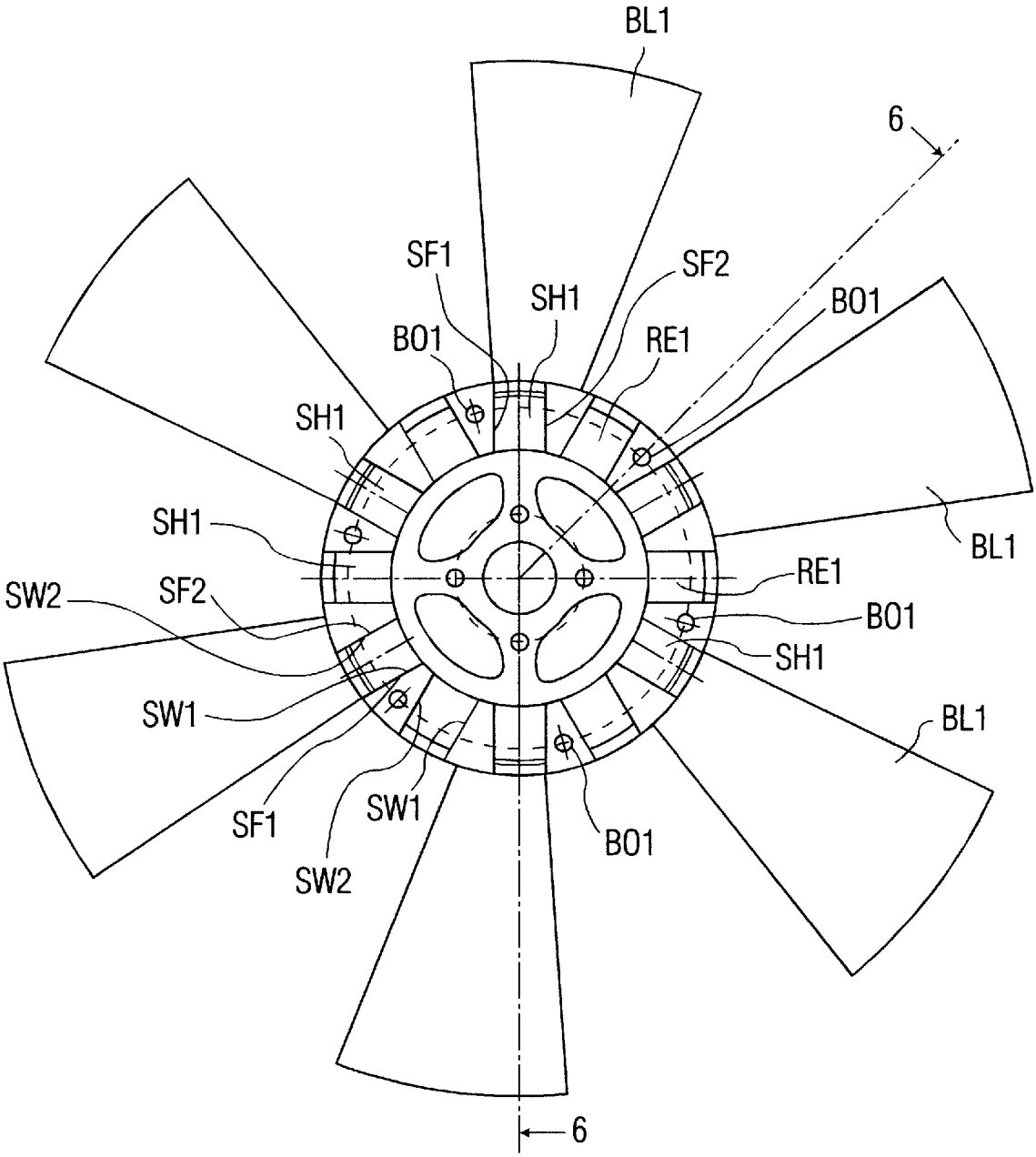
FIG. 2 is a section 2—2 of FIG. 1.

FIG. 1 is a partially sectional and partially schematic representation of a motorized fan with a motor MO1 and a fan assembly FA1. FIG. 2 is a section 2—2 of FIG. 1 viewed from the front (i.e. toward the direction of the motor MO). In FIGS. 1 and 2, the motor MO1 rotates a shaft ST1 in one rotational direction about an axis AX1, for example counter-clockwise as viewed from the front in FIG. 2. The shaft ST1 is fixed to, and rotates, the impeller assembly FA1 which includes a hub HU1 and a multiplicity of axially extending removable fan blades BL1. The hub HU1 supports the fan blades BL1 in peripherally distributed and forwardly tapered recesses RE1 some or all of which releasably hold tapered shoes SH1. The shoes SH1 each constitute an integral part of the fan blades BL1 and project axially into the recesses RE1 from the radially inner ends of the fan blades. As described below in greater detail, recesses RE1 is particularly defined by a forward and downward (meaning toward the shaft axis) sloping surface. The shoes include a forward and downward sloping surface that upon shoe insertion enters the recess until the shoe sloping surface engages the recess sloping surface as a positive stop.

An annular plate-shaped ring RI1, located behind the shoes SH1, presses the tapered or wedge-shaped shoes forward into the tapered or wedge-shaped recesses RE1 so as to hold the blades BL1 in position. Threaded bolts BO1, not shown in FIG. 1, and peripherally offset from the shoes SH1 as shown in FIG. 2, secure the ring RI1 to the hub HU1 and cause the ring to apply a forward force to the shoes urging the shoes forward into the recesses RE1. It should be understood that the ring can be of any suitable shape and the number of bolts and corresponding hub threaded opening can be any suitable number to secure all shoes to the respective recesses. The entire assembly, of course, should be symmetrical about the shaft axis.

Figure 3:
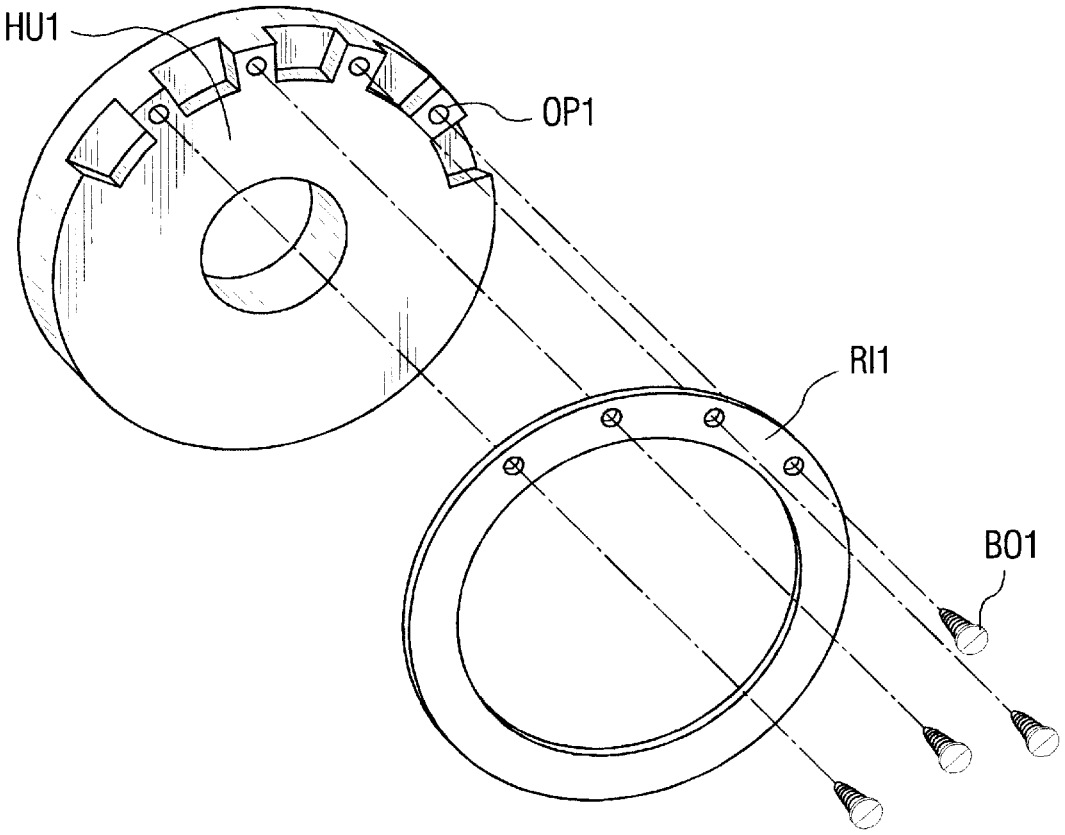
FIG. 3 is a perspective exploded view of a portion of the arrangement in FIGS. 1 and 2.

FIG. 3 is an exploded perspective showing the bolts BO1 with the ring RI1 and hub HU1 with the openings OP1. The threading of the bolts BL1, and the corresponding openings in the hub HU1 have a left or right "hand" in a direction to tighten in response to normal rotation of the hub HU1 and blades BL1. Thus, for counter-clockwise direction of the hub HU1 in FIG. 2, the threads on the bolts BL1 are left-handed.

Figure 4:
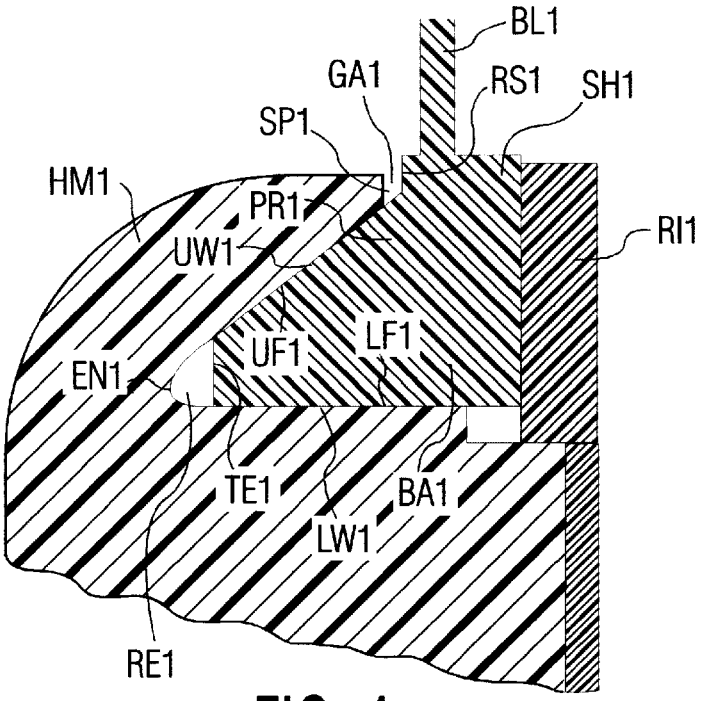
FIG. 4 illustrates details of a portion of FIG. 1.

As shown in FIG. 1, and more specifically in the detail view of FIG. 4, The tapered shoes SH1 each include a forward tapered projection PR1 and a back section BA1. Axially extending lower faces LF1 on the tapered shoes SH1 engage axially extending lower walls LW1 in the tapered recesses RE1. Angularly directed upper walls UW1 in each of the tapered recesses RE1 engage upper faces UF1 on the projecting shoes SH1. Each shoe SH1 has a terminus TE1 before an end EN1 in the recess RE1. The upper wall UW1 of the recess RE1 engages the upper face UF1 of the shoe SH1 for less than the entire length of the recess. Moreover, the upper wall UW1 ends in a step SP1 and the upper face UF1 ends in a rise RS1 that forms a gap GA1 when the shoe SH1 and the recess RE1 are fully engaged at the upper wall and the upper face. The recesses are thus blind and wall UW1 functions as a positive stop for face UF1 and SH1 on installation. Wall UW1 and the substantial hub material HM1 also serve to absorb centrifugal forces generated by blade BL1, shoe SH1 during rotation of the shaft.

According to one embodiment of the invention, the angle of taper of each projection PR1 in each shoe SH1 is 45°.

However, according to other embodiments, the angle of taper has a range of 30° to 50°. The wedge angles in the tapered recesses RE1 exhibit the same angles as the shoes SH1 which they engage.

Figure 5:
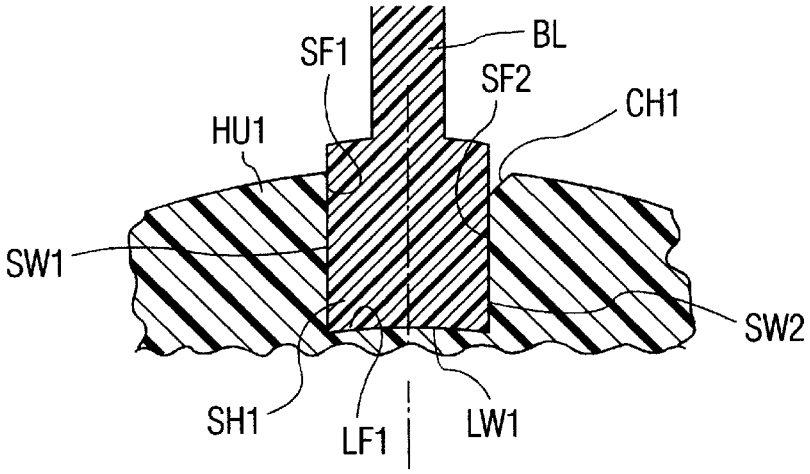
FIG. 5 illustrates details of a portion of FIG. 2.

As shown in FIG. 2, and more specifically in the detailed view of FIG. 5, the axially extending lower faces LF1 and lower walls LW1 can also extend cylindrically about the axis AX1. Parallel side walls SW1 and SW2 in each of the recesses RE1 frictionally hold substantially parallel side faces SF1 and SF2 of the shoes SH1 projecting into the recess. Each pair of side walls SW1 in a recess RE1, and each pare of side faces on a shoe SH1, are parallel to a plane extending axially along the axis AX1. It will be understood that other wall and face configurations can be used as long as the cooperating wall and face are congruent.

The angularly directed upper walls UW1 in each of the tapered recesses RE1, and the upper faces UF1 on the projecting shoes SH1, can form slightly conical surfaces about the axis AX1 so that their intersections with planes perpendicular to the axis AX1 exhibit arcs about the axis AX1. While the faces UF1 and LF1, and the walls UW1 and LW1 can be curved in a particular direction, they may according to other embodiments be curved otherwise or be flat. Preferably, the upper faces UF1 are congruent with the upper walls UW1, while the lower faces LF1 are congruent with the lower walls LW1.

The annular plate-shaped ring RI1, located behind the shoes SH1, presses the tapered shoes into the tapered recesses RE1 to ensure that the faces UF1 and LF1 of the shoes SH1 engage the walls UW1 and LW1 of the recesses RE1 engage. This holds the blades BL1 firmly in position. As long as the lower faces LF1 of the shoes SH1 engage the lower walls W1 of the recess, the upper walls UW1 engaging the upper faces UF1 constitute the forward limit of motion of the shoes.

In FIG. 5, the hub HU1 can form a chamfer CH1 at the peripheral mouth of the recess RE1. The chamfer CH1 may serve for easy initial insertion of the shoe SH1 into recess RE1.

Figure 6:
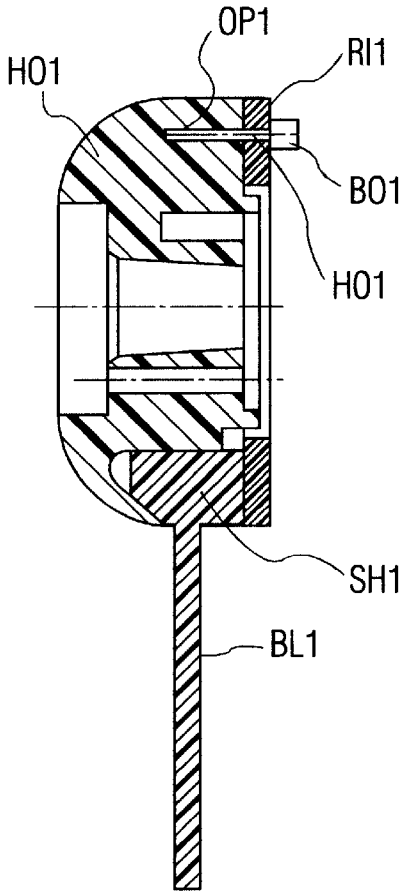
FIG. 6 illustrates a portion of the arrangement in FIGS. 1 and 2 along a section 6—6 of FIG. 2.
Figure 7:
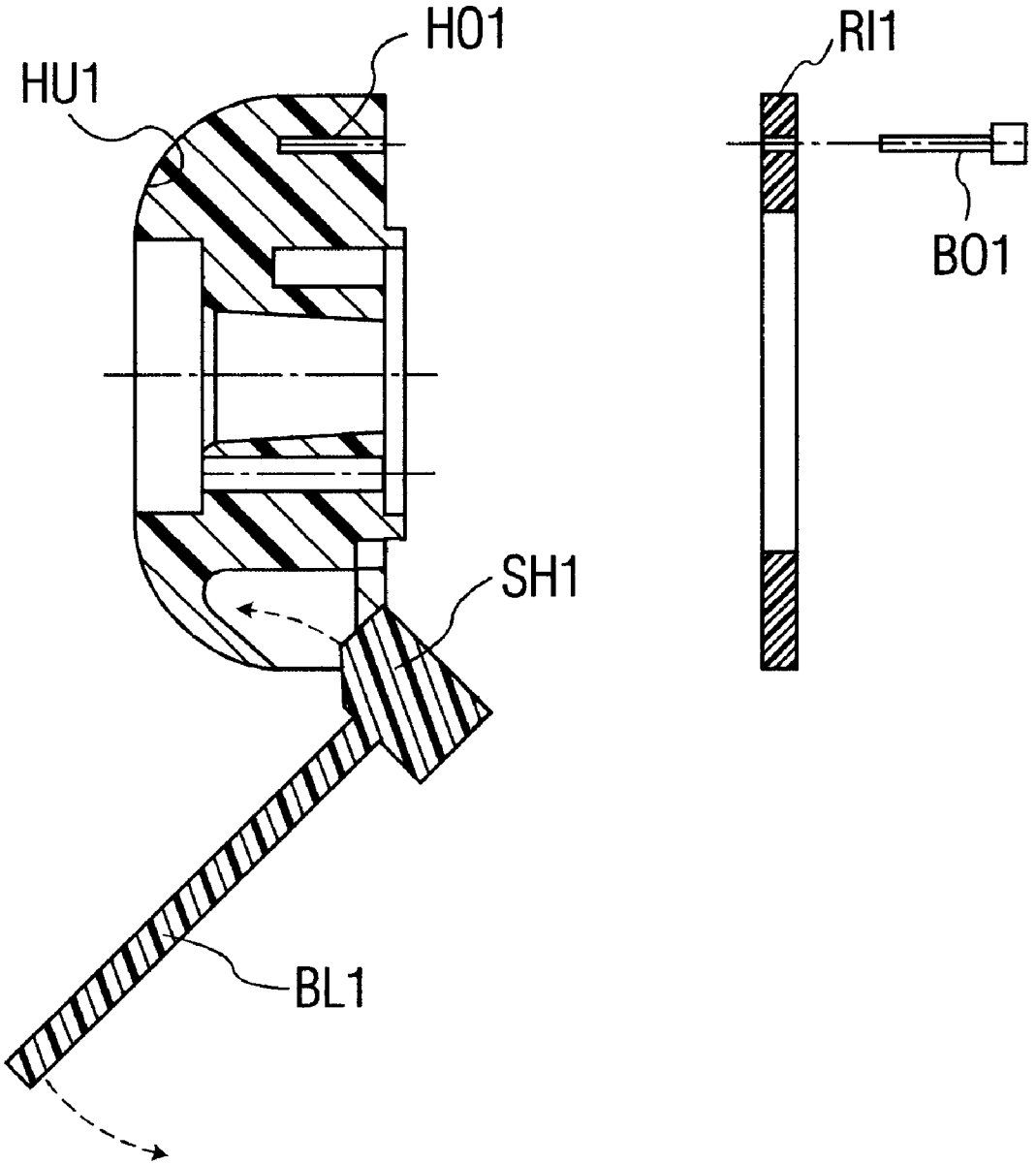
FIG. 7 is an exploded view of FIG. 5.

FIGS. 6 and 7 show further details of the ring RI1 of FIG. 3 and the manner of holding the ring RI1 axially forward. FIG. 6 illustrates the hub HU1 and the blades BL1 along a section 6—6 of FIG. 2. The section 6—6 is bent so that FIGS. 6 and 7 expose both one of the shoes SH1 and one of a multiplicity of peripherally distributed threaded openings OP1 of FIG. 2. The ring RI1 does not appear in FIG. 2 because the section 2—2 hides the ring. The sectional view of FIG. 6 shows the ring RI1 as part of a section along 6—6. FIG. 7 is an exploded version of FIG. 6. In FIGS. 3, 6, and 7, a plurality of bolts BO1 pass through peripherally distributed holes HO1 in the ring RI1 to enter openings OP1 in the hub HU1. The openings OP1 are axially and peripherally aligned with the holes in the ring RI1. When the bolts BO1 are screwed and tightened in the openings OP1 the ring RI1 presses the shoes SH1 forward with a positive axial force to assure that the faces UF1 and LF1 of the shoes SH1 engage the walls UW1 and LW1 of the recesses RE1. In this manner, the hub HU1 releasably holds the tapered shoes SH1 both frictionally and positively along the axis with the force of the ring RI1 and contacting wall UW1 and face UF1. As stated, as long as the lower faces LF1 of the shoes SH1 engage the lower walls W1 of the recess, the upper walls UW1 engaging the upper faces UF1 constitute the forward limit of motion of the shoes.

As also stated, the threading of the bolts BO1 and the openings OP1 are in a direction tending to tighten in response to normal rotation of the hub HU1 and blades BL1. Thus, for counter-clockwise direction of the hub HU1 the threads in the opening OP1 and on the bolts OP1 are left-handed.

In operation, the motor MO1 drives the hub HU1 through the shaft ST1 and rotates the blades BL1. This moves the ambient air. The rotational motion of the hub HU1 tends to cause the bolts BO1 to tighten and helps maintain the force of the ring RI1 against the shoes SH1. This sustains the force between the shoes SH1 and the recesses RE1 of the hub HU1 and secures the blades BL1 to the hub, thereby preventing stresses that might harm the blades or the hub. The tapered shapes of the shoes SH1 help secure the blades in the hub HU1 without jamming the blades in the hub. This permits easy removal and replacement of the shoes and the blades of which they are a part following removal of the bolts and ring RI1.

Figure 8:
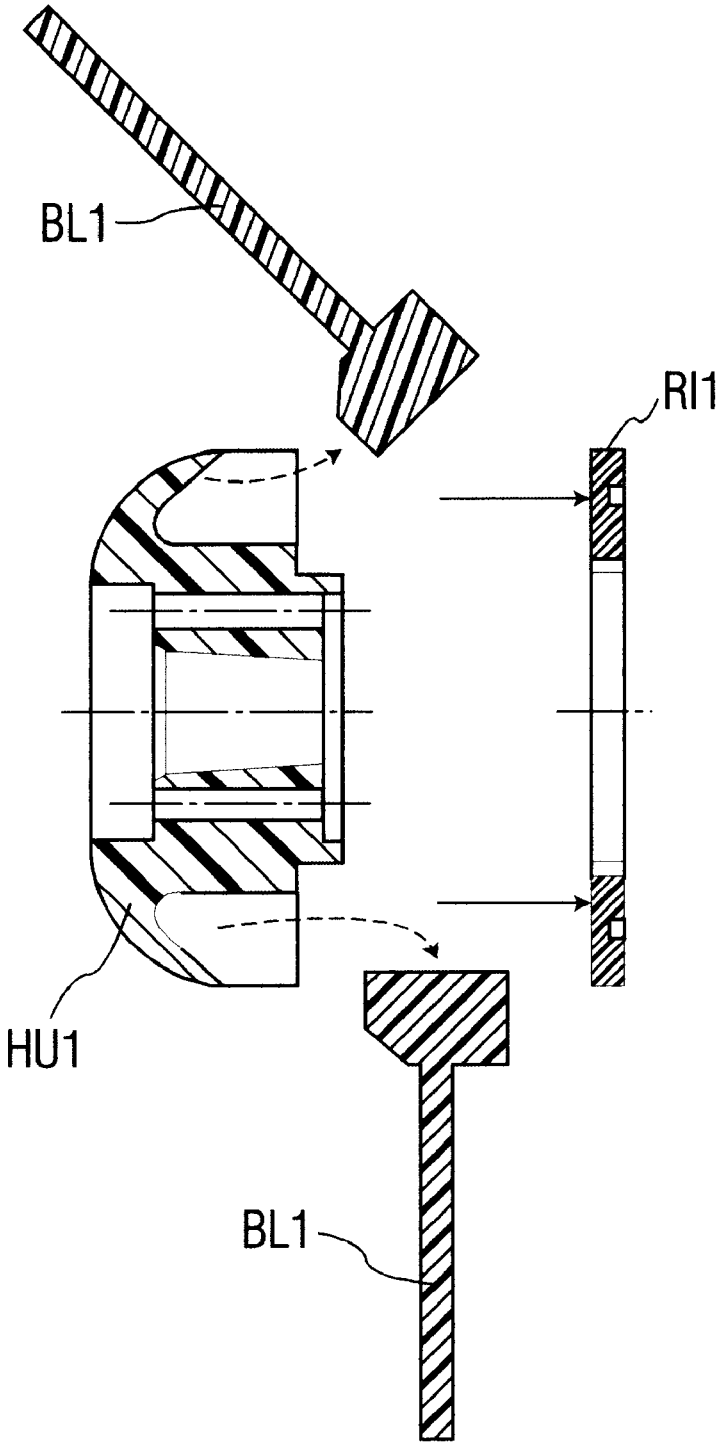
FIG. 8 is an exploded sectional view illustrating detachment of blades from a hub.

If it becomes necessary to change the number of or any defective blades BL1, the bolts BO1 are removed to detach the ring RI1 as shown generally in FIG. 8. The latter is a section similar to FIG. 1 but illustrating removal of the ring RI1 and the blades BL1 from the hub HU1. When the ring RI1 is removed, one can then remove a blade BL1 as, for example, indicated by the dashed arrows.

After removal of the blade BL1, a new blade or insert, i.e. a shoe without a blade element, is substituted by seating the shoe SH1 of the new blade or insert BL1 in the recess RE1 of the hub HU1. The chamfer CH1 shown in FIG. 5 may ease introduction of the shoe SH1. Placement of the ring RI1 behind the shoes SH1 and screwing the bolts BO1 through the holes HO1 in the ring RI1 and into the openings OP1 secures the shoes SH1 in position. This fastens the blades BL1 in their proper locations.

Because the bolts BO1 are threaded in a direction tending to tighten the bolts in response to rotation, the shoes SH1 and blades BL1 remain tightly in the recesses RE1 as the fan rotates. This provides security in the operation of the device.

Figure 9:
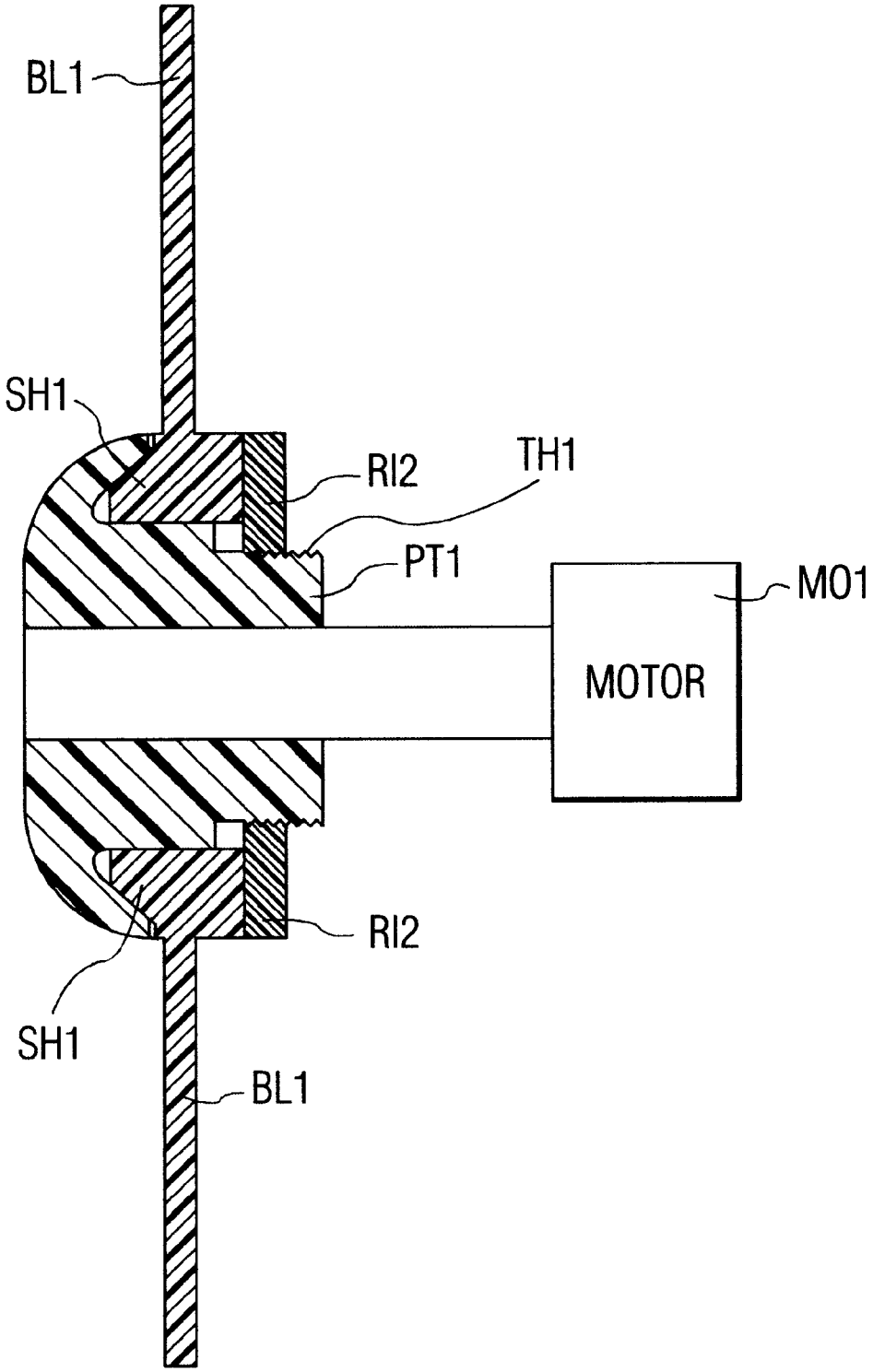
FIG. 9 is a sectional view of another embodiment of the invention.

FIG. 9 illustrates yet another embodiment of the invention. Here, parts like those of the other figures have like reference characters. In FIG. 9, a ring RI2 also presses the shoes SH1 axially. However the ring RI2 is threaded directly onto a central protuberance PT1 that extends axially from the hub HU1. The threads TH1 on both the hub HU1 and the ring RI2 have directions tending to tighten the ring on the hub during rotation of the motor MO1. Thus, the shoes remain tightly engaged in the recesses RE1 as the fan rotates.

The angle of the taper in the shoes SH1 is advantageous in allowing application of the axial force of the ring RI1 while retaining the shoes in radial position. It also permits easy removal and replacement of the blades BL1 and/or inserts.

While embodiments of the invention have been described in detail, it will be evident to those skilled in the art that the invention may be embodied otherwise. Other and further changes and modifications can be made to the herein disclosed exemplary embodiments without departing from the spirit and scope of the present invention.

What is claimed is:

1. A motorized fan, comprising:

a motor having a shaft extending longitudinally along an axis and with a preferred direction of rotation;

an impeller assembly connected to said shaft and including a hub along the axis;

said hub having a plurality of longitudinally extending tapered recesses each with a downward and forward sloping interior wall relative said axis;

a plurality of tapered shoes removably mounted in said recesses and longitudinally extending forward into said recesses, each shoe having a face releasably engaging said interior wall;

said assembly having a selectively releasable longitudinally forward directed force actuator engaging the rear portion of said shoes, and wherein said recesses are blind and continue for a first length and said shoes enter said recesses for a second length less than the first length such that when fully seated a space remains in said recess forward of said shoe.

2. A motorized fan as in claim 1, wherein said actuator defines threading having a hand supplementing the preferred direction of rotation.

3. A motorized fan as in claim 1, wherein each of said shoes and recesses have a pair of side faces adjacent a radially extending plane parallel to the axis.

4. A motorized fan as in claim 1, wherein said sloping wall in each of said recesses comprises as a positive stop for the forward seating of the respective shoe and abutting said face of said shoe for absorbing centrifugal forces of said respective blade during rotation thereof.

5. A motorized fan as in claim 4, wherein said face includes a downward and forward sloping surface having substantially same shape as said sloping wall relative to said axis.

6. A motorized fan as in claim 1, wherein radial extending blades are formed at the radially outer portions of at least some of said plurality of shoes.

7. A motorized fan, comprising:

a motor having a shaft extending longitudinally along an axis and with a preferred direction of rotation;

an impeller assembly connected to said shaft and including a hub along the axis;

said hub having a plurality of longitudinally extending tapered recesses each with a downward and forward sloping interior wall relative said axis;

a plurality of tapered shoes removably mounted in said recesses and longitudinally extending forward into said recesses, each shoe having a face releasably engaging said interior wall;

said assembly having a selectively releasable longitudinally forward directed force actuator engaging the rear portion of said shoes, and wherein said actuator comprises an annular ring abutting behind said shoes and said ring and hub comprise mutually threaded portions for securing said ring to said hub.

8. A motorized fan as in claim 1, wherein said actuator defines threading having a hand supplementing the preferred direction of rotation.

9. A motorized fan as in claim 8, wherein said wall of each said recess forms an angle of substantially between 30 and 50 degrees with the axis.

10. A motorized fan, comprising:

a motor having a shaft extending longitudinally along an axis and with a preferred direction of rotation;

an impeller assembly connected to said shaft and including a hub along the axis;

said hub having a plurality of longitudinally extending tapered recesses each with a downward and forward sloping interior wall relative said axis;

a plurality of tapered shoes removably mounted in said recesses and longitudinally extending forward into said recesses, each shoe having a face releasably engaging said interior wall;

said assembly having a selectively releasable longitudinally forward directed force actuator engaging the rear portion of said shoes, and wherein one of said mutually sloping walls in each of said recesses is substantially parallel to the axis in the longitudinal direction, wherein said recesses are blind and continue for a first length and said shoes enter said recesses for a second length less than the first length, wherein said actuator includes an actuator plate and a plurality of bolts each having threads with said threading and extending parallel to said axis and securing said plate to said hub, wherein each of said shoes and recesses have a pair of parallel side faces adjacent a radially extending plane parallel to the axis, wherein said mutually sloping walls in each of said recesses substantially parallel to the axis in the longitudinal direction has a cylindrical curvature about the axis, wherein said plate releasably abuts said blades behind said shoes, wherein another of said walls of said recess forms an angle of substantially 45 degrees with the axis, wherein two walls in each of said recesses extend substantially radial of the axis but parallel to each other, two faces of said shoes extend substantially radial of the axis and parallel to each other, and said two radially extending walls form a close fit with said radially extending faces, and wherein radial extending blades are formed at the radial outer portions of at least some of said plurality of shoes.

* * * * *

UNITED STATES PATENT AND TRADEMARK OFFICE

CERTIFICATE OF CORRECTION

PATENT NO. : 6,139,277
DATED : October 31, 2000
INVENTOR(S) : Edward Lopatinsky

It is certified that error appears in the above-identified patent and that said Letters Patent is hereby corrected as shown below:

Claim 2, column 5,
Lines 14 - 16, change to:
-- 2. A motorized fan as in claim 1, wherein said actuator includes an annular actuator plate and a plurality of threaded members securing said plate to said hub. --.

Claim 8, column 6,
Line 1, change "1" to -- 7 --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*